United States Patent [19]

Hasenbalg

[11] 4,146,336

[45] Mar. 27, 1979

[54] KEYBOARD ACTUATOR FOR TYPEWRITERS AND THE LIKE

[76] Inventor: Ralph D. Hasenbalg, 8635 Rudnick, Canoga Park, Calif. 91304

[21] Appl. No.: 816,308

[22] Filed: Jul. 18, 1977

[51] Int. Cl.[2] ..... B41J 5/30

[52] U.S. Cl. ..... 400/61; 400/70; 400/474

[58] Field of Search ..... 197/19, 20, 98; 178/17 C, 81; 200/1 R; 335/112; 400/61, 70, 71, 473, 474

[56] References Cited

U.S. PATENT DOCUMENTS

| | | | |
|---|---|---|---|
| 638,591 | 12/1899 | Murray | 197/19 |
| 2,282,107 | 5/1942 | Watson | 197/19 |
| 2,433,349 | 12/1947 | Drewell | 197/19 |
| 3,249,199 | 5/1966 | Jones | 197/19 |
| 3,340,985 | 12/1967 | Sinila | 197/19 |
| 3,837,458 | 9/1974 | Bretti et al. | 197/19 |
| 4,050,566 | 9/1977 | Webb et al. | 178/17 C X |

FOREIGN PATENT DOCUMENTS

| | | | |
|---|---|---|---|
| 1293731 | 10/1972 | United Kingdom | 197/19 |

*Primary Examiner*—Paul T. Sewell

[57] ABSTRACT

Actuators are positioned over the rows of keys in a keyboard to drive the keys in response to coded information from a computer or other source of digital signals. The mechanical driving force is transferred from solenoids positioned at one end of each row simultaneously to all of the actuators of that row. Additional solenoids positioned across the bottom of the keyboard sequentially unlatch selected actuators allowing them to drive their associated keys in response to the driving force. Additional solenoids are used to drive the shift mechanism and, if necessary, other individual keys.

10 Claims, 4 Drawing Figures

FIG. 1
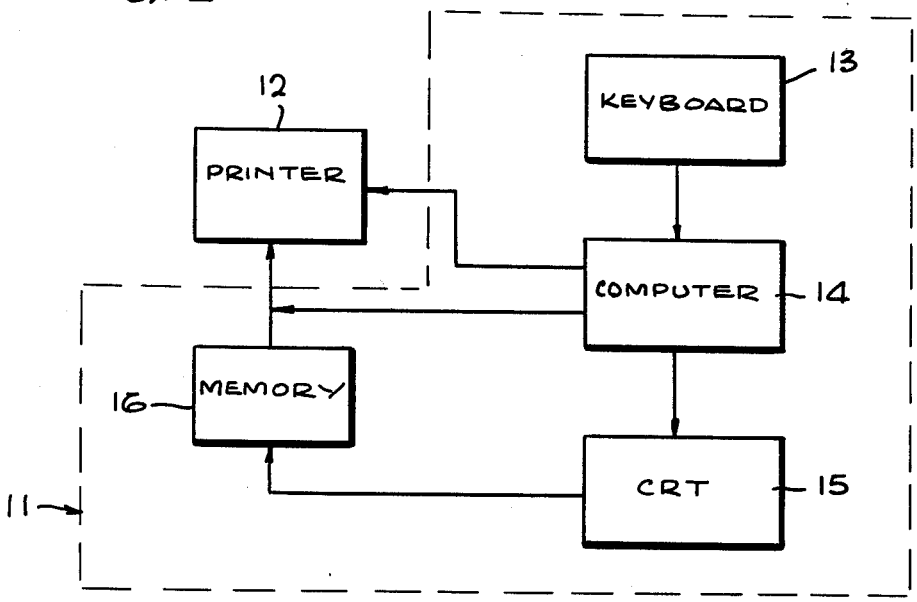
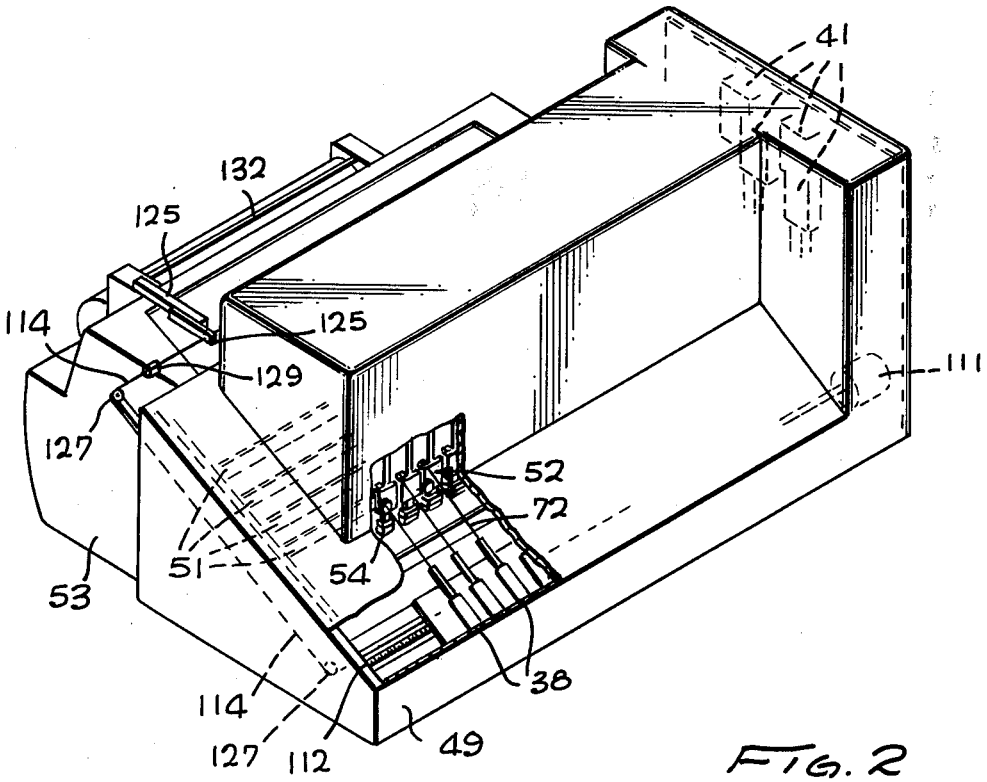
FIG. 2

KEYBOARD ACTUATOR FOR TYPEWRITERS AND THE LIKE

BACKGROUND OF THE INVENTION

This invention relates to keyboard-operated devices, such as typewriters and the like, and more particularly to computer-controlled devices of this type. More particularly it pertains to actuating means for converting standard keyboard-operated machines from manual to computer control.

Ever-increasing demand for word and figure processing capability has lead to the advent of a variety of computer-controlled typewriters, printers, calculating machines and similar devices. Since most of these devices are intended for use in business and professional offices and commercial concerns, the thrust of their development has been in the direction of compactly packaged high-performance units incorporating a variety of sophisticated functions. Not unexpectedly their cost has been commensurate with their sophistication.

A typical word processing system provides a more or less conventional typewriter or computer terminal keyboard on which the operator composes the material to be typed or printed. A hard or soft copy first draft is produced for reviewing and editing. Means are provided for producing second and subsequent drafts incorporating such corrections, additions, deletions or other changes as may be desired until a final draft in acceptable form is achieved. This may be stored for future use, reproduced in single or multiple ribbon-copies, or used in a variety of other ways.

Although their specific components and functions are many and varied, these prior art devices are generally adapted to bypass the keyboard-operated type selection and actuation mechanism when they are in the hard copy-production mode. Most commonly, solenoid-operated mechanical latching means are employed to select the type characters, and some form of clutching arrangement is used to connect the printing head or type bar to a source of driving force to accomplish the typing or printing. The keys themselves do not move during the typing or printing operation.

The principal object of the subject invention is to provide a low cost printer utilizing a conventional typewriter or keyboard-operating device.

Another object is to provide means for converting a standard manual or electrical typewriter into a high-speed computer-operated printer having substantially all of the features presently available only in sophisticated expensive word processing systems.

Many other objects and advantages will become apparent from the following description of a preferred embodiment of the invention.

BRIEF DESCRIPTION OF THE INVENTION

The preferred embodiment of the invention comprises an array of mechanical actuators positioned over the keyboard of a standard typewriter. The individual actuators are moveable to conform to the size and configuration of the particular keyboard and are aligned in registry with the respective keys. The actuators drive the keys in response to coded information from a computerized compositor or other source of digital signals.

Typically, mechanical driving force for the actuators is supplied by four solenoids associated with the rows of keys and positioned at one end of the keyboard. Thirteen additional solenoids are positioned across the bottom of the keyboard and connected to latching mechanisms associated with the respective actuators. An additional solenoid is used to drive the shift mechanism of the typewriter. For use with typewriters that do not have a power carriage return, a motor and lead screw are provided.

Force to drive the keys of each row is transferred from the respective drive solenoid to the actuators of that row by a cord threaded through all of the actuators. When a character is to be printed, the latching solenoid associated with that key's actuator is energized to unlatch its latching mechanism. The driving solenoid associated with the row containing that key is then energized, applying a driving force to all of the actuators in that row, but driving only the unlatched actuator against its associated key. In this manner the keys are selected and driven in sequence to print any desired message.

The construction and function of this embodiment of the invention will be more fully appreciated, from the following detailed description taken in connection with the accompanying drawings.

DESCRIPTION OF THE DRAWINGS

In the drawings:

FIG. 1 is a block diagram of the elements of a computerized printing system embodying the subject invention;

FIG. 2 is a perspective view of a conventional manual typewriter with the actuating mechanism of the subject invention partially broken away for illustrative purposes;

Figure 3:
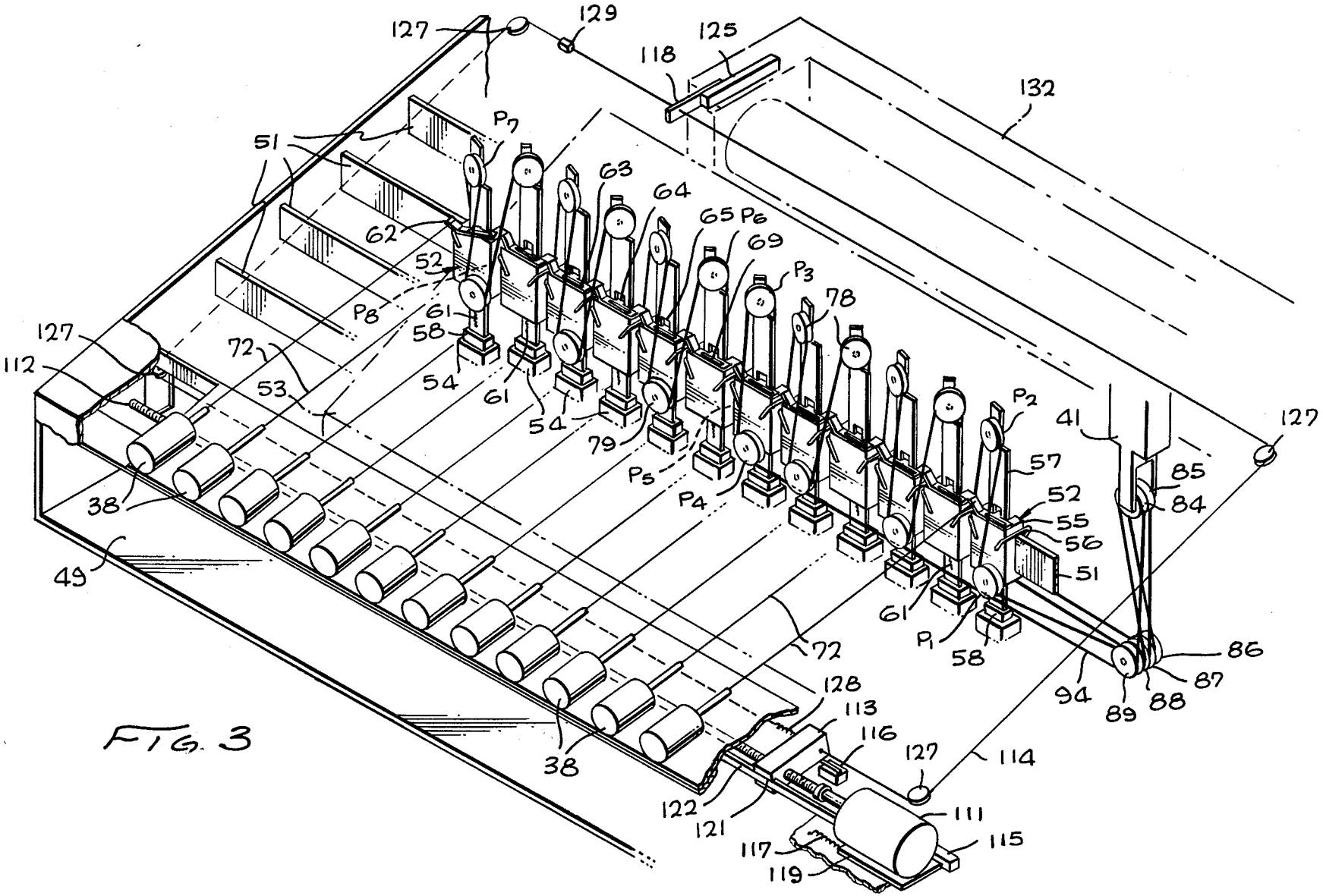
FIG. 3 is a simplified perspective view of a portion of the actuator array and carriage return of the subject invention.

Wherever practicable a single numeral will be used to designate the same or functionally similar components.

DETAILED DESCRIPTION OF THE INVENTION

Referring to FIG. 1, a typical computerized printing system embodying the subject invention consists of a computerized compositor 11 and a printer 12. The compositor 11 comprises a keyboard or terminal 13 connected through a standard digital computer 14 to a cathode ray tube or other suitable visual display device 15 and to a magnetic or punched tape, card or other suitable memory recording and playback device 16. In the customary manner the compositor 11 permits successive drafts of the material to be printed to be displayed visually and edited until final draft in acceptable form has been achieved and stored in digitized form in memory 16, for further processing or printing. The printer 12 may receive its data input directly from computer 14 or some other source of parallel digital data, but normally it is fed by memory 16. Typically the digitized character data are ASCII coded, but of course other codes can be used.

Figure 4:
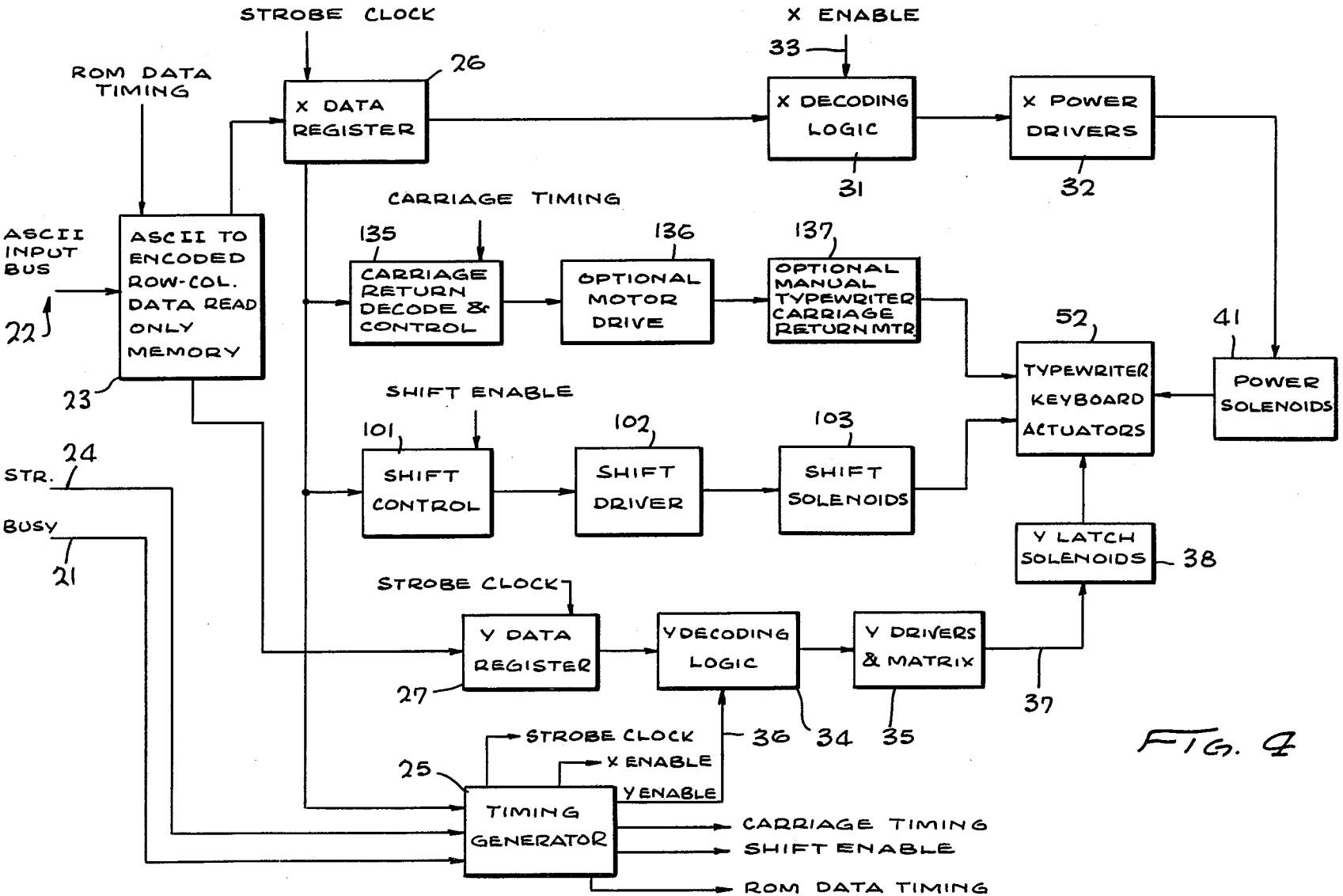
FIG. 4 is a block diagram of the principal elements of the printer of the subject invention.

Referring to FIG. 4, sensed signal means, designated generally by the numeral 21 is provided to indicate that printer 12 is busy and cannot receive additional data. When the printer BUSY warning 21 is no longer asserted, the printer 12 is ready to receive character signal 22 from any external source.

As the coded signals associated with each successive character are received by ROM 23 the data lines are set.

When the data lines and ROM 23 are stable, strobe 24 is asserted to start a timing generator 25 and strobe data into the data registers 26, 27. Two of the ROM's 256 four bit words are used for each strobe input. ROM data are loaded into the four bit Y register 27 on the leading edge of the strobe, and while the strobe is high, data are loaded from another ROM address into four bit X register 26. The second ROM address is selected by controlling one of the ROM address lines with a signal derived from the strobe signal itself. The printer 12 now asserts a busy signal 21 until it is ready for the next data word.

Timing signals for the printer 12 are supplied by a gated clock and a four bit counter. In addition to being turned on and off, the clock rate changes in response to logic levels. The printer BUSY signal is generated from the carry output of the counter.

The X decoding logic 31 generates the input command to the X power drivers 32 from the output of the X data register 26 and the X ENABLE timing signal 33. Similarly, the Y decoding logic 34 generates the input command to the Y drivers 35 from the output of the Y data register 27 and the Y ENABLE timing signal 36.

To reduce the number of Y drivers 35 required, the Y driver outputs 37 drive the Y solenoids 38 through a 4 × 4 matrix. Eight Y drivers 35 are therefore required to drive the 13 latch solenoids 38, one at a time. If it were necessary, the implemented 4 × 4 matrix could, of course, drive 16 Y solenoids 38 without adding Y drivers 35.

The X power drivers 32 supply current to the X power solenoids 41, but never to more than one at a time. In operation, the selected Y latch solenoid 38 is energized first in response to the Y ENABLE timing signal 36, and the X power solenoid 31 is then energized in response to the X ENABLE timing signal 33.

Before continuing with the block diagram, an operational description of the keyboard actuator mechanism is in order. FIGS. 2 and 3 illustrate this mechanism. Typically, four parallel actuator-supporting beams 51 are secured to a sturdy base 49 on which a conventional manual typewriter 53 is mounted. The supports 51 are arranged in ascending steps conforming to the pitch of the typewriter keyboard, with one positioned above each of the four rows of keys 54.

A plurality of key actuators 52, normally from twelve to fourteen, are mounted to each support 51.

A typical actuator 52 comprises a body 55 straddling the support 51 and slidingly secured to it by a spring clip 56, and a plunger 57 slidingly retained in a vertical channel formed in body 55. Actuator 52 may be readily moved along support 51 to position plunger 57 directly above its associated typewriter key 54.

The lower end of plunger 57 carries an enlarged striker 58 of suitable resilient material, shaped to conform to the upper surface of the key 54. A tension spring 61 attached to the body 55 and the lower end of plunger 57, urges the latter upwardly.

A latch 62 is pivotably mounted to body 55 by means of a pin 63. An ear 64 is formed on latch 62 in vertical alignment with an opening 65 in plunger 57. A torsion spring 69 attached to the body 55 and latch 62 maintains the latter in contact with plunger 57 and forces the ear 64 into the opening 65 when the two are in registry, thereby immobilizing plunger 57.

A latch cord 72 is connected between the free end of latch 62 and its associated normally extended latching solenoid 38 which is effectively secured to the base 49. Typically, each latching solenoid 38 is connected in this manner to the latches of one actuator 52 on each of the four supports 51.

A first pulley 78 is supported on the upper end of plunger 57, and a second pulley 79 on the actuator body 55.

Four normally extended drive solenoids 41 are effectively mounted to the base 49 and positioned above the ends of actuator supports 51. Each drive solenoid 41 carries a pair of coaxially mounted pulleys 84, 85. Four coaxially mounted guide pulleys 86, 87, 88, 89 are effectively secured to base 49 and positioned below the pulleys 84, 85 of each of the drive solenoids 41 adjacent the ends of supports 51.

Mechanical force is transmitted from the drive solenoids 41 to the typewriter keys 54 through a drive cord 94. The cord 94 passes over pulleys 85 and 87 and then over pulleys $P_1$ and $P_2$ of the actuator 52 closest to drive solenoid 41. It will be noted that the lower pulleys 79 on the actuators 52 are on alternate sides of supports 51, and the upper pulleys 78 are alternatingly canted about 45° out of alignment with supports 51. This arrangement permits cord 94 to be threaded from pulley $P_2$ to the lower and upper pulleys 79, 78 of successive actuators 52 on alternating sides of support 51. This not only allows larger pulleys 78, 79 to be used, but additionally enhances the stability of the actuators 52. Preferably the actuators 52 are divided into two equal groups, those lying to the right and those lying to the left of the imaginary center of supports 51. The cord 94 passes around pulleys $P_3$ and $P_4$ of the last actuator 52 in the right hand group and thence around pulleys 89, 84 and 88 and back to pulleys $P_5$ and $P_6$ of the first actuator 52 in the left-hand group. From pulley $P_6$ it is threaded as previously described over the lower and upper pulleys 79, 78 of the intermediate actuators 52 of the left-hand group and finally around pulleys $P_7$ and $P_8$ of the last actuator of that group and back around pulley 86. The ends of cord 94 passing around pulleys 85 and 86 are spliced together to form a continuous drive loop. The two passes through the drive solenoid pulleys 84, 85 reduce by almost one-half the distance the drive solenoid 41 must travel during the actuation cycle. This reduction allows the solenoid to operate through the optimal portion of its force stroke characteristic. The division of the actuators 52 into two groups, each driven by a portion of cord 94 passing over a separate set of pulleys 78, 79, 84–89 substantially reduces the frictional loss inherent in the drive system.

From the foregoing description of the mechanical construction of the actuator mechanism it will be apparent that on activation of drive solenoid 41 tension in the drive cord 94 transmits force to all of the actuators 52 on the associated support 51, but only the solenoid 52 previously unlatched by operation of its associated latching solenoid 38 will be driven downwardly against its key 54.

Returning to FIG. 4, the shift control block 101 and the shift driver block 102 consist of two "and" gates and two drivers to drive the shift solenoid 103. One or the other of the drive currents to the shift solenoid 103 is generated whenever the shift bit in the X data register 26 is true. During the time that the SHIFT EN timing signal is true a high power pulse is sent to the shift solenoid 103 to insure that the shift actuator 52 is driven forcefully to the shifted condition. During the time that the SHIFT EN timing signal is not generated a low power current is sent to the shift solenoid 103 to hold the shift actuator 52 down. This arrangement allows fast operation of the shift function, decreases heating in the shift solenoid 103 and power drivers 32, 35 and keeps the shift actuator 52 from moving continuously whenever the shifted function is requested for sequential characters.

The carriage return decode and control can be optionally configured to drive a manual or power return typewriter. Before continuing with the block diagram description, the manual version mechanical components and basic operation will be presented.

Referring to FIGS. 2 and 3, the major mechanical parts for the manual typewriter carriage return comprise a motor 111, carriage lead screw 112, lead screw block 113, return drive cord 114, return reverse switch 115, return stop switch 116, return override springs 117, return arm bracket 118, and the motor slide bracket 119. The motor 111 drives the lead screw 112 which is threaded through block 113. The block 113 is restrained from turning by conventional means such an axial channel 121 adapted to slide on a bar 122 connected to the base 49 of the apparatus. The motor 111 is mounted on the motor slide bracket 119 which allows the motor 111, the lead screw 112 and the lead screw block 113 to move axially whenever the tension in the override springs 117 is exceeded. Return arm bracket 118 is secured to the return arm 125 of the typewriter. Force to move the return arm 125 is transferred from lead screw block 113 to return arm bracket 118 by the return cord 114. One end of the cord fastens to block 113. The other end is threaded around positioning pulleys 127 and through an eye in the return arm bracket 118 and is attached to block 113 by a small tension spring 128. At the proper location on cord 114 a bead 129 is fastened to supply force to return arm bracket 118.

In operation, the motor 111 drives the lead screw assembly until the bead 129 and cord 114 comes into contact with the return arm bracket 118. The motor 111 continues to drive until the typewriter carriage 132 reaches its stop. With further movement of drive cord 114 prevented, continued operation of motor 111 forces the motor 111 axially against override springs 117 until motor reversing switch 115 is actuated. Actuation of the switch 115 causes the control circuits to reverse the motor drive. Motor drive now continues until the block 113 actuates the carriage return stop switch 116. To reduce lost time between carriage return operation, typing is allowed to resume before the block 113 reaches the rest position. Also, at the time typing is allowed to resume, the motor drive voltage (and therefore speed) is reduced so that if only a few characters are printed on the line, the return operation will be faster.

As indicated in FIG. 4, the carriage return decode and control circuitry 135 may operate the optional motor drive 136 connected to the manual drive mechanism just described 137, or when used with a typewriter having a powered carriage return, may be connected directly to the appropriate keyboard actuator 52 to operate the typewriter return key.

Typically, in addition to the normal characters, shift and carriage return, the preferred embodiment is programmed to utilize one of the actuators 52 to operate the back space key. Other functions such as tabs could be implemented but since the previously described programmed functions can provide any output within the typewriter's capability, the increased performance could not justify the additional complexity and cost.

It should be understood that the particular construction and function of the embodiment described in detail were chosen for illustrative purposes and are not to be deemed as limitations on the scope of the invention as defined in the following claims.

What is claimed is:

1. An automated device for actuating the keys of a keyboard-operated mechanism in response to coded information from a computer or other source of digital signals, comprising:

a base for immovably supporting said mechanism;

a framework including a plurality of actuator-supporting beams rigidly mounted to said base in alignment with, and spaced from said keys;

a plurality of actuators mounted to said beams, positioned adjacent to, and upon activation operable to actuate said keys;

drive means mounted to said base in association with respective ones of said beams;

linkage means connecting the respective drive means associated with each of said beams with, and effectively transmitting said activating force from said drive means simultaneously to, a plurality of the actuators mounted to the beam associated with said drive means;

latch means mounted to said framework, releasably engaging, and thereby effectively immobilizing respective ones of, said actuators;

latch-releasing means associated with, and upon activation disengaging said latch means from, said respective actuators;

re-latching means associated with each of said actuators for re-engaging said actuator and its associated latch means following activation of said actuator; and control means sequentially selectively activating said latch releasing means and said drive means in response to said coded information, whereby upon receipt of such coded information, said latch releasing means effectively disengages said latch means from one of said acutators and thereupon said drive means applies activating force simultaneously to said plurality of actuators, thereby activating only said one actuator to actuate the key associated therewith.

2. An automated device as defined by claim 1, wherein said actuators are mounted to said beams for movement axial of said beams into registry with respective ones of said keys.

3. An automated device as defined by claim 1, wherein said re-latching means comprise resilient means urging said latch means into engagement with said actuator.

4. An automated device as defined by claim 3, wherein said actuators comprise:

a plurality of plunger-supporting means slidably mounted to said beams;

a plurality of elongated plungers supported by said plunger-supporting means for movement into actuating engagement with said keys;

plunger-activating means associated with said plunger-supporting means operatively connected to, and activating said plungers on activation of, said drive means.

5. An automated device as defined by claim 1, in combination with a keyboard-operated mechanism.

6. An automated device as defined by claim 1, in combination with a keyboard operated typewriter.

7. An automated device as defined by claim 4, wherein said linkage means comprise:

first pulleys carried on the end of said plungers remote from said keys;

second pulleys carried on said plunger-supporting means;

third pulleys carried on, and movable radially upon activation of said drive means;

fourth pulleys secured to said base adjacent said beams between said third pulleys and said actuators; and an endless flexible power transmitting element threaded around said first, second, third and fourth pulleys, whereby actuator-activating force is effectively transmitted from said drive means to said plungers in response to activation of said drive means.

8. An automated device as defined by claim 7, wherein:

said drive means include a plurality of drive solenoids mounted to said framework and upon activation moving said third pulleys in a direction radially away from said fourth pulleys; and said latch releasing means include a plurality of latch solenoids connected to said latching means and upon activation selectively releasing said latching means from engagement with said plungers.

9. An automated device as defined by claim 8 for actuating the keys of a typewriter having a movable carriage operated by a carriage-return arm, comprising further:

carriage-return means for operatively engaging said carriage-return arm; and powered means mounted to said base effectively driving said carriage-return means in response to said coded information.

10. An automated device as defined by claim 9, comprising further:

a lead screw mounted to said base;

a reversible motor mounted to said base driving said lead screw in response to said coded information;

a block threaded on said lead screw;

restraining means secured to said base in engagement with, and preventing rotation of said block;

a pair of pulleys secured to said base at opposite ends of the carriage of said typewriter;

an endless flexible power-transmitting element threaded around said pulleys and secured to said block, whereby said carriage is returned upon operation of said motor in one direction; and switch means mounted to said base reversing the direction of operation of said motor in response to the return of said carriage.

* * * * *